United States Patent [19]

Zitz et al.

[11] 4,098,539

[45] Jul. 4, 1978

[54] CUTTING MACHINE

[75] Inventors: Alfred Zitz; Otto Schetina, both of Zeltweg; Peter Kogler, Knittelfeld; Arnulf Kissich, Zeltweg, all of Austria

[73] Assignee: Vereinigte Osterreichische Eisen- und Stahlwerke - Alpine Montan Aktiengesellschaft, Vienna, Austria

[21] Appl. No.: 719,156

[22] Filed: Aug. 31, 1976

[30] Foreign Application Priority Data

Sep. 2, 1975 [AT] Austria ..... 6768/75

[51] Int. Cl.[2] ..... E21C 27/24

[52] U.S. Cl. ..... 299/75; 299/86; 299/89

[58] Field of Search ..... 299/75, 76, 78, 87, 299/89, 90, 71, 85, 86; 175/319, 106

[56] References Cited

U.S. PATENT DOCUMENTS

| | | | |
|---|---|---|---|
| 2,721,733 | 10/1955 | Driehaus | 299/89 X |
| 2,808,253 | 10/1957 | Miller | 299/89 X |
| 2,920,879 | 1/1960 | Driehaus | 299/87 X |
| 3,157,438 | 11/1964 | Lundquist | 299/89 X |
| 3,290,096 | 12/1966 | Stalker | 299/78 |
| 3,773,384 | 11/1973 | Anderson | 299/89 X |
| 3,834,763 | 9/1974 | Sigott | 299/89 |

FOREIGN PATENT DOCUMENTS

| | | | |
|---|---|---|---|
| 152,165 | 11/1950 | Australia | 299/75 |

*Primary Examiner*—Ernest R. Purser
*Attorney, Agent, or Firm*—Cushman, Darby & Cushman

[57] ABSTRACT

A cutting machine has at each side of a universally pivotable cutter boom a cutting head which is rotatably supported around an axis extending vertically to the longitudinal direction of the cutter boom and which is advanced in direction of its axis when the cutter boom is pivoted. The cutting heads are propelled by a drive unit via a reduction gearing arranged within the cutter boom, the last stage of the reduction gearing being arranged within cutting heads which are hollow.

6 Claims, 3 Drawing Figures

CUTTING MACHINE

Figure 1:
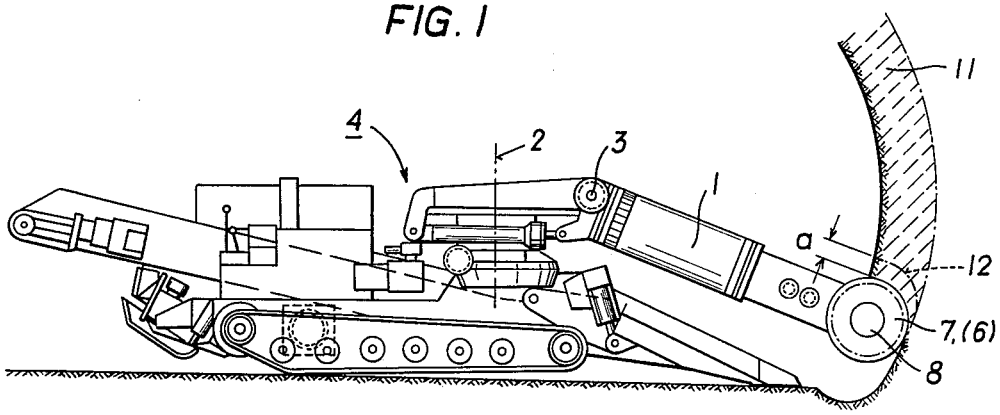

The invention refers to a so-called partial cut cutting machine, i.e. a cutting machine in which the cutting head is arranged on a universally pivotable cutter boom and is moved along the working field. The invention particularly refers to a special construction of such a cutting machine in which at each side of a universally pivotable cutter boom one cutting head is rotatably supported to be rotated around an axis extending vertically to the longitudinal direction of the cutter boom and is advanced in direction of its axis when swivelling the cutter boom, noting that the cutting heads are propelled by a drive unit via a reduction gearing arranged within the cutter boom. When advancing the cutting heads in direction of their axes, which as a rule are horizontally arranged, only the foreward cutting head performs its cutting work, noting that the right-hand cutting head and the left-hand cutting head alternately come in cutting position. However, when beginning the cutting operation, both cutting heads must be advanced into the rock. On beginning the cutting work at the working field, the cutting heads are pressed into the working field by advancing the cutting machine. When having cut the first line in direction of the axes of the cutting heads, the cutting heads are, by swivelling the cutter boom, first moved in a direction vertical to their axes whereupon a new line is cut in opposite direction by the other cutting head. Both cutting heads are arranged laterally of the end of the cutter boom and thus have in axial direction a distance from one another corresponding to the width of the end of the cutter boom. This has as a result that when advancing the cutting heads in a direction vertical to the axes of the cutting head there is remaining a rib of rock having a width corresponding to the width of the end of the cutter boom. This rib must be broken away or must be removed by the cutting action of that cutting head, which is the rearward cutting head as seen in cutting direction. The greater the width of this rib the more time-consuming is the work to remove this rib. When cutting vaulted profiles, as is for example the case in tunneling, the vault at the apex must change over into a straight line which is longer for one width of a cutting head than is the distance of the greatest cutting heads from one another because the rib at the apex of the vault must be removed by reciprocal movement of the cutting head in direction of its axis. This flattening on the apex detracts from the stability of the vault.

For driving the cutting heads it is necessary to transmit a high torque to the cutting heads. The revolution speed of the cutting heads is lower than the revolution speed of the drive motor arranged within the cutter boom. In known arrangements the last gear of the gearing is arranged on the shaft of the cutting heads, is rotating with the same speed as rotate the cutting heads and must withstand the same high torque as must the cutting heads, noting that the whole reduction of revolution speed must be attained between the drive motor and the cutting head, i.e. within the cutter boom. As a rule, this last gear is a spur gear and must be given a great axial length to be in the position to transmit the required torque. This results in a relatively great width of the end of the cutter boom and also in a relatively great distance between both cutting heads, what again results in a rib of great width between both cutting heads. Such a broad rib can no more be broken away but must be removed by cutting in a time-consuming operation.

It is an object of the present invention to avoid these drawbacks in a cutting machine of the kind described above. The invention essentially consists in that at least the last stage of the reduction gearing is arranged within hollow cutting heads. In this manner, the last gear arranged within the cutter boom is rotating with a speed of revolution which is greater for an amount corresponding to the speed reduction of the gearing arranged within the cutting heads as compared with the speed of revolution of the cutting heads. The torque acting on this last gear within the cutter boom becomes thus lower so that the axial length of this gear can, as compared with known arrangements, be reduced for the speed reduction ratio of the gearing arranged within the cutting heads. This allows to reduce the width of the end of the cutter boom and thus also to reduce the distance between the cutting heads so that also the rib formed in a rock has a substantially reduced width. This narrow rib can either be broken away or at least be cut away with substantially less time expenditure. This not only reduces the energy requirement but also allows to shorten the resulting straight line at the apex so that the stability of the vault is increased. According to the invention it is convenient to arrange a reduction gearing in each of the cutting heads and to propel these reduction gearings by a common gear bearingly supported within the cutter boom.

According to a preferred embodiment of the invention, the reduction gearing arranged within the cutting head is a planetary gearing, the sun or central gear of which is connected to the drive gear and the hollow ring gear of which forms the shaft of the cutting head. Such a construction of the reduction gearing arranged within the hollow cutting head allows to make best use of the cavity and to attain a high reducing gear ratio. Conveniently, the cutting head is rotatably supported on the hollow wheel forming the shaft and connected to the hollow wheel via a slipper clutch. In this manner, peak loads acting on a blocked cutter can be counteracted before damaging the cutter because the rotating masses between cutter and clutch are reduced to a minimum. Above all, the rotating masses which must be slowed down by the action of the cutter are rotating with the slowest speed and it is not neccessary to slow down those parts of the reduction gearing which rotate with higher speed, so that the influence of inertia forces is reduced to a minimum.

This embodiment provides a simple construction. According to the invention the sun central gears of both planetary gearings may be bearingly supported within the drive gear in an overhung fashion and may be clamped with one another by means of a central screw, whereas the carrier of the planet pinions of the planetary gearing may be or otherwise fixed to the cutter boom.

The invention is further illustrated with reference to the drawing showing an embodiment of the invention.

In the drawing

Figure 2:
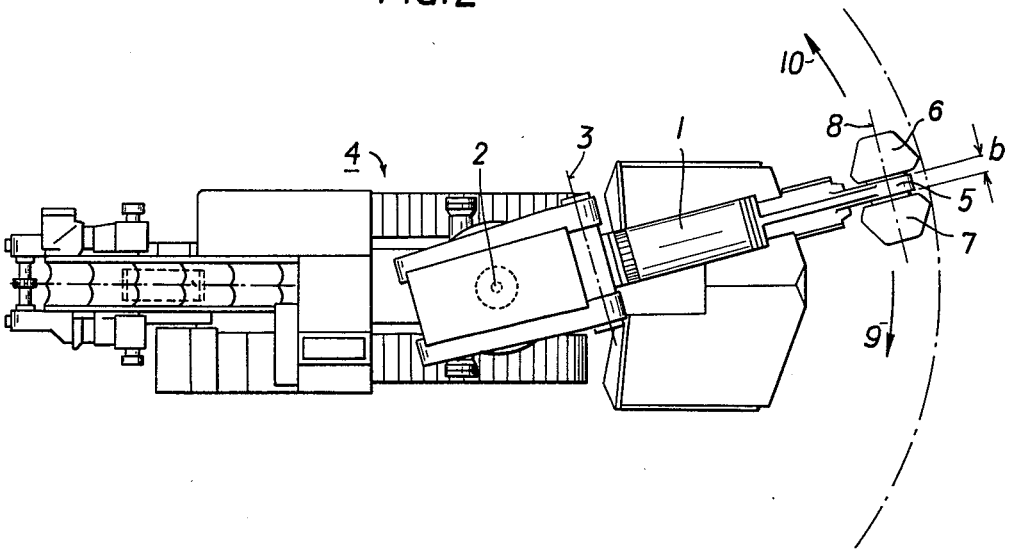
Figure 3:
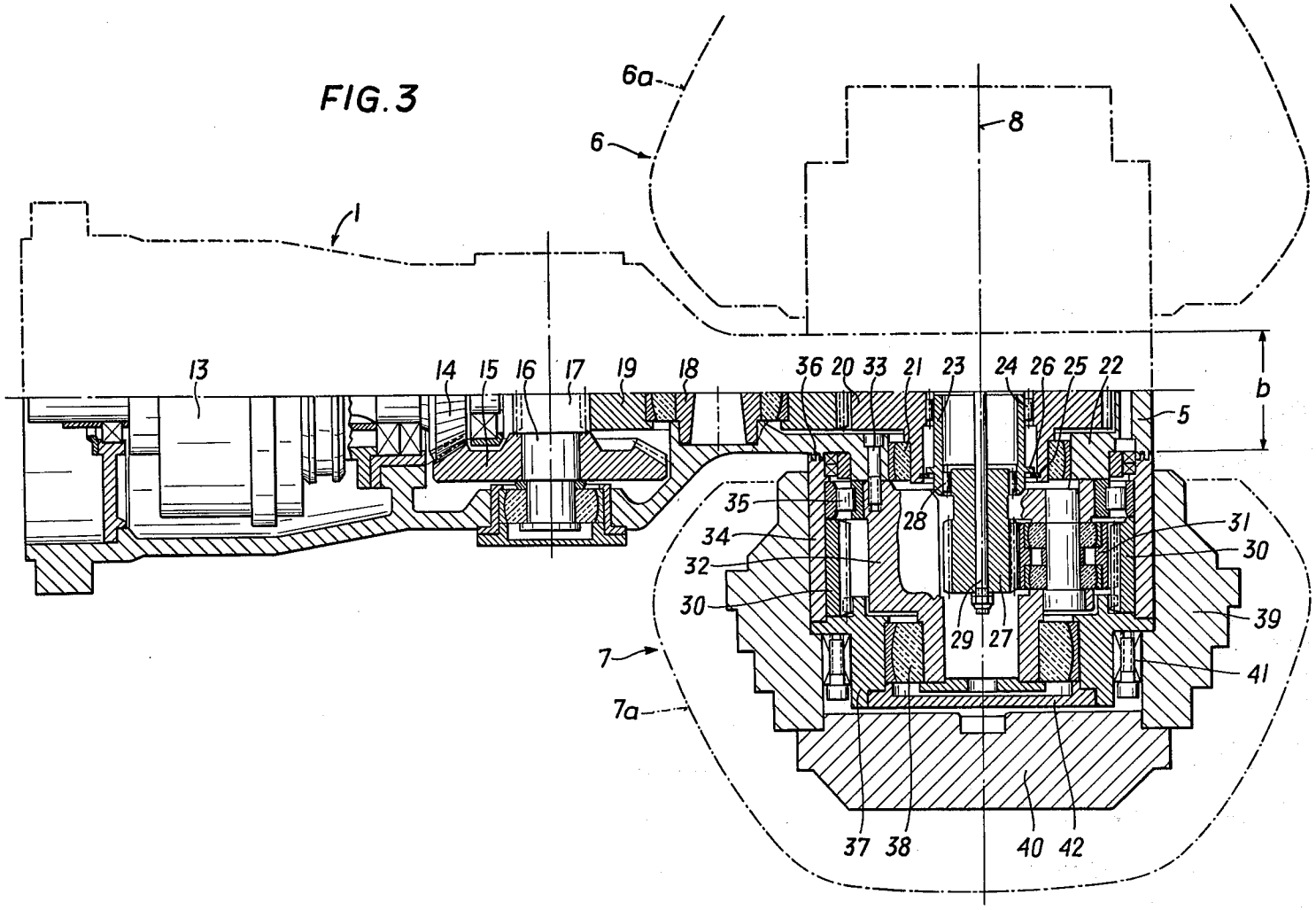

FIGS. 1 and 2 show a cutting machine in operating position in a lateral view and in a top-plan view, respectively, thereby FIG. 1 showing the cutter boom in a central position, and FIG. 3 represents the foreward end of the cutter boom together with the cutting heads, partially in a top-plan view and partially in a horizontal axial section.

As is shown in FIGS. 1 and 2, the cutter boom 1 is arranged for pivotal movement around a vertical axis 2 and around a horizontal axis 3 relative to the chassis of the cutting machine 4. At the foreward end 5 of the cutter boom 1, two cutting heads 6 and 7 provided with bits are arranged at either sides of the cutter boom for being rotated around an axis 8. Advancing of the cutting head is effected by alternately swivelling the cutter boom around the vertical axis 2 in direction of arrows 9 and 10. On advancement in direction of arrow 9, the cutting head 7 is cutting, whereas on advancement in direction of arrow 10 the cutting head 6 is cutting. As soon as the cutter boom has reached its end position at the left-hand side or at the right-hand side, the cutter boom is swivelled around its horizontal axis 3 in vertical direction. When working in upward direction there results the condition as represented by FIG. 1, noting that the layer 11, represented by the hatched area, is cut off line by line. In this case, the cutting heads are lifted from line to line for a distance *a* corresponding to the socalled total thickness of cut, noting that in each line a sector of material is removed by cutting as is illustrated by the dashed line 12. When lifting the cutter boom, i.e. when passing over from one line to the other, the cutting heads must be moved into the rock for the distance *a* which is called "penetration depth". The cutting heads are arranged from one another by a distance *b* as is defined by the width of the end 5 of the cutter boom, so that there remains within the rock a rib approximately having the width *b* and the height *a*. The shape of this rib is indicated in FIG. 1 by the dashed line 12. This rib must be broken away by swivelling the cutter boom 1 around its vertical axis 2 or must be cut away. Breaking of the rib requires less energy than cutting, howeverm it is only possible to break away ribs of an only limited width *b*. Therefor, this width *b* shall be as small as possible.

FIG. 3 represents the construction of the drive unit of the cutting heads 6 and 7. The enveloping surface of the cutter bits are indicated by the dashed-dotted lines 6*a* and 7*a*. The cutting heads are, via a change-speed gearing, propelled by a motor (not shown) arranged within the cutter boom 1. On the output shaft of the change-speed gearing there is arranged a small bevel gear 14 which mates a big bevel gear 15, which is keyed on the shaft 16 of a spur pinion 17. A bigger spur gear 19, which is rotatable around the axis 18, mates the spur pinion 17 and a spur gear 20 mates said spur gear 19. The gears 14, 15 and 19 are bearingly supported within the cutter boom 1. The spur gear 20 is arranged within the cutter boom 1 adjacent the end 5 thereof.

The gear 20 is bearingly supported by means of two bearings 21 within a part 22 of the casing of the cutter boom 1. Two coaxial bushings 23 are arranged in the interior of the gear 20 and coupled to the gear 20 by means of claws 24. Snap rings 25, cooperating with flanges 26 of the bushings 23, secure said bushings 23 against axial movement within the gear 20. Two pinions 27 are coupled by means of claws 28 within the two bushings 23 and clamped together by means of a central screw 29.

The pinion 27 is the sun or central gear of a planetary gearing arranged within the corresponding cutter head. 30 is the hollow ring gear and 31 are the planet pinions of said planetary gearing. In each cutting head there are provided three planet pinions 31 and arranged relative to one another for an angle of 120°. The planet pinions 31 are bearingly supported within a carrier 32 which is firmly screwed by means of screws 33 to the part 22 of the casing of the cutter boom 1. A socket 34 is fixedly connected, on the one hand, to the hollow wheel 30 and, on the other hand, to an annular part 37. The socket 34 is, together with the hollow wheel 30, bearingly supported by means of a roller bearing 35 on the carrier 32 which is in its turn firmly connected to the part 22 of the casing of the cutter boom. The annular part 37 is also rotatably supported on the carrier 32 by means of a bearing 38. The socket 34 is sealed against the cutter boom 1 by means of a labyrinth seal 36. 42 is a cover which is sealingly screwed on the annular part 37. The gearing is thus completely sealed against foreign matter and forms with the interior of the cutter boom 1 a common space which can be filled with oil.

39 is the body of the cutting head and 40 is the cover of the cutting head tightly screwed to the body 39. Both parts 39 and 40 are carrying bits.

The body 39 of the cutting head is rotatably supported on a socket 34. 41 is a slipper clutch of usual construction which couples the body 39 of the cutting head to the socket 34 and therewith also with the hollow wheel 30 and which is slipping only when the torque exceeds a predetermined value.

The cutting heads 6 and 7 are, via the described planetary gearing, driven by the gear 20 in a speed ratio which is defined by the ratio of the pitch circle diameter of the sun gear 27 to the pitch circle diameter of the hollow wheel 30. The cutting heads 6 and 7 are thus rotating with a smaller speed than the spur gear 20, so that the torque to be transmitted by the spur gear 20 is smaller than the torque exerted by the cutting heads 6 and 7, what allows to correspondingly reduce the axial length of the spur gear 20 and therewith also the width of the end 5 of the cutter boom 1. For example, the speed ratio between the sun wheel 27 and the hollow wheel 30 is approximately 4:1 in the embodiment shown in the drawing. Thus, the torque to be transmitted by the spur gear 20 amounts to only one forth of the torque exerted by the cutting heads. In view of the last gearing stage being installed within the hollow cutting head, the axial length of the spur gear 20 is only one forth of that axial length which would be required if the whole gearing would be arranged within the cutter boom and the spur gear 20 would rotate with the same speed as rotate the cutting heads. The width *b* of the end of the cutting head is thus reduced to one forth and the width of the rock rib remaining between both cutting heads is also reduced to one forth.

What we claim is:

1. Cutting machine comprising a universally pivotable hollow cutter boom which carries at each side a hollow cutting head rotatably supported around a common axis extending transversally to the longitudinal direction of the cutter boom whereby the cutting heads are advanced in direction of said common axis when swivelling the cutter boom, the cutting heads being propelled by a drive unit via reduction gearing, said reduction gearing including a driving gear within the boom and including a planetary gear set arranged within each cutting head, each planetary gear set having a central gear driven by said driving gear about said common axis, a ring gear rotatable about said common axis and drivingly connected to the respective cutting head, pinion gears drivingly connected to said central gear and to said ring gear and a pinion gear carrier fixed to said boom, the arrangement thereby permitting the distance between the cutting heads to be maintained small.

2. Cutting machine as claimed in claim 1, wherein the driving connection between the ring gear and the cutting head includes a slipper clutch.

3. Cutting machine as claimed in claim 1, wherein one front side of each ring gear is sealed against the cutter boom, for example by means of a labyrinth seal.

4. Cutting machine as claimed in claim 1 wherein the central gears of both planetary gear sets are centrally bearingly supported within the driving gear in an overhung fashion and are clamped together by means of a central screw.

5. In a cutting machine: a pivotable hollow cutter boom carrying at its outer end two cutter heads disposed on opposite sides of the boom, said cutter heads being rotatable about a common axis transverse to the longitudinal axis of the boom; a drive train carried within the boom for rotating said cutter heads, said drive train having a drive gear located within the boom at the outer end thereof and between said cutter heads, said drive gear being rotatable about said transverse axis, each of said cutter heads being hollow and containing a planetary reduction gear set having an input central gear driven by said drive gear about said transverse axis, an output ring gear rotatable about said transverse axis and driving the respective head, pinion gears drivingly connected to said central gear and to said ring gear and a pinion gear carrier fixed to said boom, whereby the arrangement permits a relatively small axial width of said drive gear and hence a relatively small spacing between said cutter heads.

6. A cutting machine as in claim 5 wherein the central gear of each reduction gear train is connected to said drive gear to rotate therewith, wherein the respective cutter head is connected to the respective ring gear to rotate therewith.

* * * * *